US010478648B2

(12) United States Patent
Basseches

(10) Patent No.: US 10,478,648 B2
(45) Date of Patent: Nov. 19, 2019

(54) FIRE SUPPRESSION APPARATUS AND METHOD FOR FLAMMABLE LIQUID STORAGE TANK RIM SEAL GAP AREA

(71) Applicant: Alexandre F Basseches, Teaneck, NJ (US)

(72) Inventor: Alexandre F Basseches, Teaneck, NJ (US)

( * ) Notice: Subject to any disclaimer, the term of this patent is extended or adjusted under 35 U.S.C. 154(b) by 447 days.

(21) Appl. No.: 14/809,711

(22) Filed: Jul. 27, 2015

(65) Prior Publication Data

US 2017/0028235 A1 Feb. 2, 2017

(51) Int. Cl.

| | |
|---|---|
| ***A62C 3/06*** | (2006.01) |
| ***A62C 35/10*** | (2006.01) |
| ***A62C 99/00*** | (2010.01) |

(52) U.S. Cl.

CPC ..... *A62C 3/065* (2013.01); *A62C 35/10* (2013.01); *A62C 99/0009* (2013.01)

(58) Field of Classification Search

CPC ..... A62C 3/065; A62C 35/10; A62C 99/0009

USPC ..... 169/43, 45, 46, 47, 49, 56, 58, 66, 68

See application file for complete search history.

(56) References Cited

U.S. PATENT DOCUMENTS

| | | | |
|---|---|---|---|
| 3,896,881 | A | 7/1975 | De Boer |
| 4,004,708 | A | 7/1977 | Boyd |
| 4,781,252 | A | 11/1988 | Wilburn et al. |
| 5,296,164 | A | 3/1994 | Thach et al. |
| 5,330,009 | A | 7/1994 | Zhang |
| 5,434,192 | A | 7/1995 | Thach et al. |
| 6,948,567 | B1 | 9/2005 | Cyphers et al. |
| 8,297,460 | B2 | 10/2012 | Riordan |
| 8,336,637 | B2 | 12/2012 | Alsaffar |
| 8,616,398 | B2 | 12/2013 | Riordan |
| 2012/0018178 | A1 | 1/2012 | Stambaugh et al. |
| 2012/0312564 | A1 | 12/2012 | Seliverstov et al. |
| 2013/0206428 | A1 | 8/2013 | Phillips et al. |

*Primary Examiner* — Christopher S Kim

(74) *Attorney, Agent, or Firm* — Sanford J. Pitch

(57) ABSTRACT

A fire suppressant system mounted above the flammable liquid within the rim space between a floating roof and the tank wall that stores solid fire suppressant materials within a container reactant to increased temperature by disintegrating and dropping the fire suppressant material to create an oxygen barrier and retard the spread of a fire.

18 Claims, 4 Drawing Sheets

124
122
26
30
120a
16
10
12
120b
36
14
25
40
18
27
29

FIRE SUPPRESSION APPARATUS AND METHOD FOR FLAMMABLE LIQUID STORAGE TANK RIM SEAL GAP AREA

BACKGROUND OF THE INVENTION

The present invention resides in the field of fire suppression, and more particularly fire suppression for flammable liquid storage tanks. The invention is intended for use in land or vehicle housed storage tanks for retaining volatile, flammable fluids that has a gap between the storage tank shell or outer wall and a floating roof for covering the stored fluid.

Bulk fluids, such as petroleum, other fuel products and by-products, and chemicals are often stored in large tanks. These tanks are commonly designed with internal floating roofs or bulk fluid covers to minimize product losses to the outside environment and contain volatile gases within the confines of the storage tank. A critical part of the internal floating roof is the annular or rim space between the perimeter of the internal floating roof and the inner wall of the storage tank. In order to retain separation between the stored volatile fluid and the outside environment a rim space seal must be employed.

Three types of rim space seals are commonly known in the industry. These types of seals have been tested for their efficiency in reducing evaporative losses from the rim space. The seal types are: liquid-mounted resilient-filled seal; mechanical shoe seal; and vapor-mounted resilient-filled seal. These seals have been used for decades and their relative length of service is known. Testing has revealed that the most efficient seal is a liquid-mounted seal, followed by a mechanical shoe seal and finally a vapor-mounted seal. Seal efficiency has been shown to increase when a secondary seal is placed above the first seal.

The rim space in a storage tank is prone to fires due to lightning strikes or other spontaneous combustion due to static electricity, accumulated over-heated gas, and the like. The energy surge will ignite the product stored in the tank in any exposed area such as the rim space. Considerable effort has been put into the design of tanks to install fire extinguishing systems that fight rim space fires.

Conventional firefighting systems usually consist of a foam delivery apparatus that is commonly manually activated by personnel monitoring the storage tank. The fire extinguishing system would be activated upon detection of a fire within the storage tank. Detection can occur when an internal sensor indicates an alarm condition or by external visual indication such as smoke. Either occurrence may span a considerable amount of time in order to detect a fire, allowing the fire to expand to the entirety of the storage tank rim space. In addition, the heat of the expanded fire may affect the structural integrity of the storage tank wall. A significantly reduced fire would significantly reduce the high temperatures of a rim space fire and minimize potential damage to the storage tank wall; also preventing a more catastrophic event of a breach or explosion.

Storage tanks housing flammable fluids are usually outfitted with a rim space foam delivery firefighting system. The foam will inundate the rim space to suppress and eventually remove the oxygen from the surface of the fluid extinguishing the fire. In practice, the time period from the time a fire is detected until the foam is actually delivered to the rim space at the fire location is approximately 3-5 minutes after activation. However, it can take up to several hours or even days for visual smoke to be seen emanating from the rim space of a tank to be noticed or for the fire detection systems to indicate a positive detection of a fire.

Only then will the foam system be activated. In such an extended time period, a fire could expand from a localized area to one that could encompass the entire rim space.

One fire protection device that appears to have a similar construction is described in U.S. Pat. No. 6,948,567 [Cyphers, et al.] teaches the use of a rectangular box-like container for holding a fire extinguishing material that will disperse that material under either a ballistic or explosive impact or through heat induced melting of the outer face. The fire extinguishing material is described as a powder and the container is structured with internal ribs for transferring energy from the rear side to the front in order to shatter or create a fissure for the fire extinguishing material to disperse. However, there is no direct indication at what location this box-like container would be placed in a storage tank holding flammable liquids.

It is, therefore, an object of the present invention to provide a fire suppressant system that is located within the rim space of a storage tank in substantial proximity to the fluid surface. It is a further object of the present invention to maintain that close proximity of the fire suppressant system to the fluid surface by allowing the fire suppressant system to rise and fall with the fluid level within the storage tank.

It is also an object of the present invention to provide the fire suppressant material and container in such location as to not interfere with the sealing system between the floating roof and the storage tank wall, or conversely, the sealing system to not interfere with the fire suppressant system. It is yet another object of the present invention to provide a fire suppressant system composed of intumescent materials in the form of smaller bodies housed within a box-like container that will release the bodies in response to intense heat or ballistic or explosive contact spreading the intumescent bodies across the surface of the flammable liquid.

Other objects will appear hereinafter.

SUMMARY OF THE INVENTION

A fire suppressant system is described for retarding the spread of a fire of a stored flammable liquid in the rim space between a floating roof and the wall of a storage tank. A fire suppressant material is retained within a container that is immediately responsive to increased heat of a fire by disintegrating and dropping the fire suppressant material onto the stored liquid creating an oxygen barrier and retarding the spread of the fire. A plurality of containers are mounted to the circumference of a floating roof at predetermined locations around the rim, within the rim space at a height above the surface of the stored liquid and below the top of the floating roof. Mounted in these predetermined locations each individual container will be independently responsive to a significant increase in temperature such that the container will disintegrate dropping its fire suppressant materials onto the surface of the stored liquid.

The fire suppressant materials are designed only to retard the spread of the fire by creating a surface blockage starving the fire of oxygen until a fire extinguishing agent can reach the affected area. The fire suppressant materials can be formed in any geometric shape and can be made of plastic or intumescent material for a longer life span before consumption by a stored liquid fire.

A part of the present invention is the fire suppression apparatus for retarding the spread of a fire of a stored flammable liquid in the annular space between a floating roof and the wall of a storage tank. The fire suppression apparatus includes a series of containers for holding a plurality of small fire suppressant bodies that are mounted at predetermined locations along the rim surface circumscribing the floating roof above the flammable liquid and within the annular space created between the floating roof and the wall of the storage tank by a self-centering seal extending over the surface of the flammable liquid. Each of said series of containers is responsive to a significant increase in temperature caused by the combustion of the flammable liquid such that the temperature increase will rupture or disintegrate the container affected releasing the plurality of small fire suppressant bodies to the liquid surface below. The small fire suppressant bodies will drop from each disintegrating or rupturing container of the one or more affected series of containers to the flammable liquid surface creating an oxygen barrier over the flammable liquid along said liquid surface for suppressing any fire within the annular space.

Each of the series of containers is mounted along the rim of the floating roof between the surface of the flammable liquid and the top of the floating roof and is dimensioned to fit within the annular space along the rim of the floating roof so as not to be crushed and ruptured as the floating roof continues to self-center itself on the surface of the flammable liquid. The predetermined locations for mounting of each of the series of containers along the rim of the floating roof are determined based upon the number of small fire suppressant bodies that can be housed within the said containers and the surface area of the flammable liquid that these small fire suppressant bodies must cover to create the oxygen barrier for fire suppression.

The small fire suppressant bodies are selected from the group consisting of any possible solid geometric shape capable of being retained in maximum number within each of said plurality of containers. The material used for the small fire suppressant bodies is selected from the group consisting of high temperature plastics, intumescent materials, or combinations thereof.

Additionally the present invention includes a method for the retarding the spread of a fire within the annular space formed between a floating roof and the wall of a flammable liquid storage tank. This method includes the providing of a series of containers for holding a plurality of small fire suppressant bodies mounted at predetermined locations along the rim surface circumscribing the floating roof above the flammable liquid within the annular space created between the floating roof and the wall of the storage tank by a self-centering seal extending over the surface of the flammable liquid. Further, each of said series of containers is responsive to a significant increase in temperature caused by combustion of the flammable liquid by rupturing or disintegrating releasing the plurality of small fire suppressant bodies to the liquid surface below. The dropping of the small fire suppressant bodies from each disintegrating or rupturing container of the affected ones of the series of containers to the flammable liquid surface creates an oxygen barrier over the flammable liquid along said liquid surface for suppressing any fire within the annular space.

The method for retarding the spread of a fire further includes mounting each of said series of containers along the rim of the floating roof between the surface of the flammable liquid and the top of the floating roof and dimensioning each of the series of containers to fit within the annular space along the rim of the floating roof so as not to be crushed and ruptured as the floating roof continues to self-center itself on the surface of the flammable liquid. The method also includes the mounting of the series of containers along the rim of the floating roof at a number of locations that are determined based upon the number of small fire suppressant bodies that can be housed within the containers and the surface area of the flammable liquid that these small fire suppressant bodies must cover to create the oxygen barrier for fire suppression.

The method further includes the selecting of the shape for the small fire suppressant bodies from the group consisting of any possible solid geometric shape capable of being retained in maximum number within each of said plurality of containers. Finally, the method includes the selecting of the material for said small fire suppressant bodies from the group consisting of high temperature plastics, intumescent materials, or combinations thereof.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
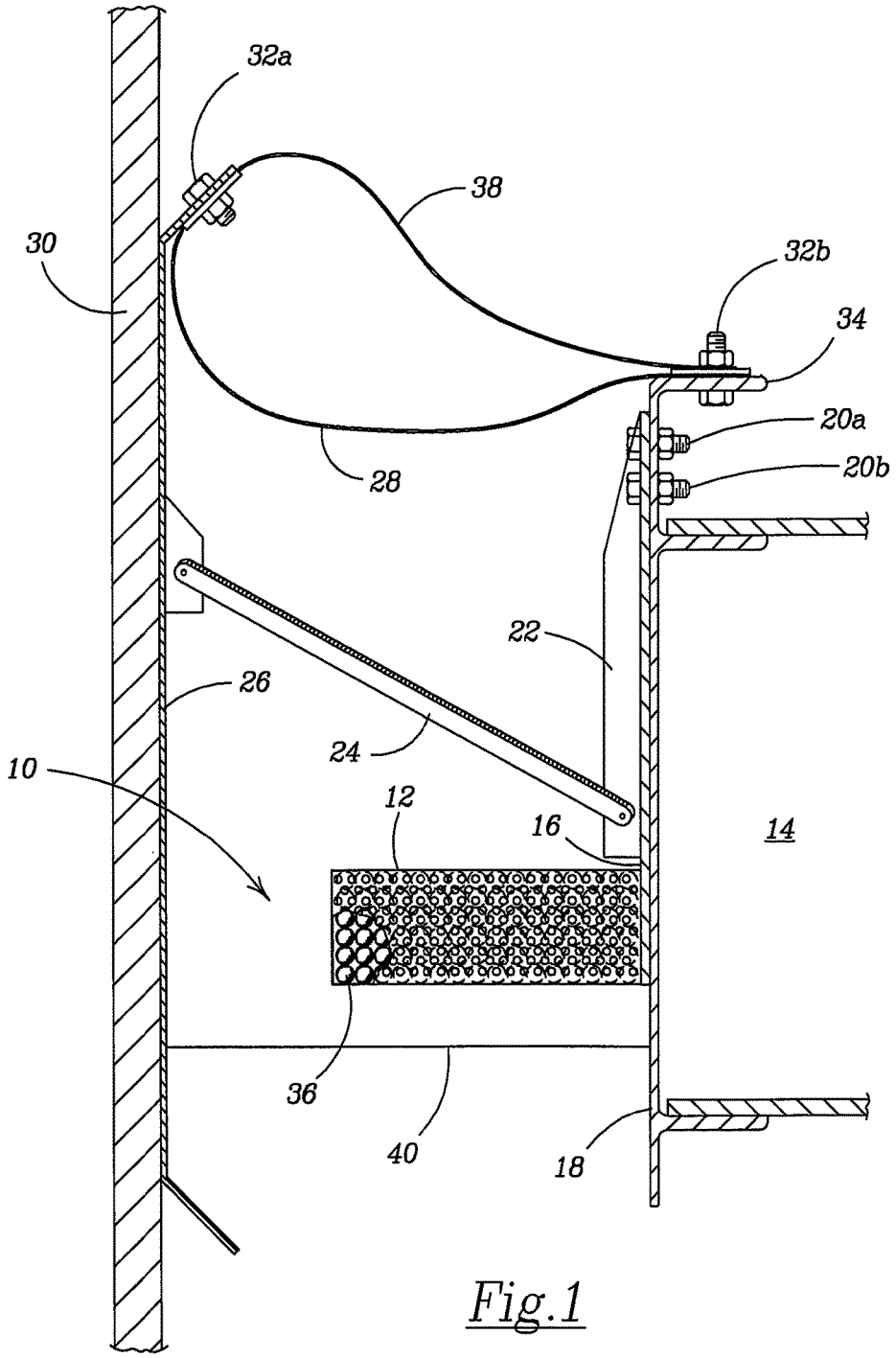
FIG. 1 is a side elevational view of the box-like container of the present invention partially cut away to reveal the fire suppressant materials housed therein disposed within the rim space by mounting to the exterior of the floating roof above the stored liquid surface and below the fabric seal located at the top of the floating roof.

Referring now to the drawings in detail, where like numerals refer to like parts or elements, there is shown in FIG. 1 the fire suppressant system 10 of the present invention. The fire suppressant system 10 is housed within a box-like rectangular container 12 that is mounted to the exterior circumference of the floating roof 14 by hangers 16. The hangers 16 are spaced apart from each other to provide stability and support in hanging the container 12 and may be attached to any point on the circumference of the rim 18 of the floating roof 14. In the example shown in FIG. 1, one hanger 16 is bolted to the rim 18 at a point just above the top of the floating roof 14 by bolts 20*a*, 20*b*. The bolts also attach the hanger 22 and support arm 24 for the shoe portion 26 of the seal extending between the tank wall 30 and the rim 18 of the floating roof 14. The second segment of the vapor seal is the fabric 28 extending across the space between the top of the shoe 26 and the top of the rim 18 of the floating roof 14 held in place in both locations by a set of bolts 32*a*, 32*b* securing the fabric to the top of the shoe 26 and to the top of and right-angle extension arm 34 extending upward from the rim 18 of the floating roof 14. Both the shoe 26 and the fabric 28 extend completely around the rim 18 of the floating roof 14 to seal off any evaporated vapor from the liquid stored below the floating roof 14 from the remainder of the internal environment of the tank, or to the atmosphere above the floating roof in a tank without a closed roof. At certain points around the perimeter of the floating roof 14 a static charge shunt 38 connects the shoe 26 with the floating roof 14 in an attempt to reduce any static electrical discharge in the rim space area reducing the chance of a spontaneous fire initiating due to the static discharge. The floating roof 14 is disposed partially within the liquid stored in the tank, with the liquid actually supporting the floating roof 14 such that the roof floats with only a small portion submerged below the liquid surface 40.

Figure 2:
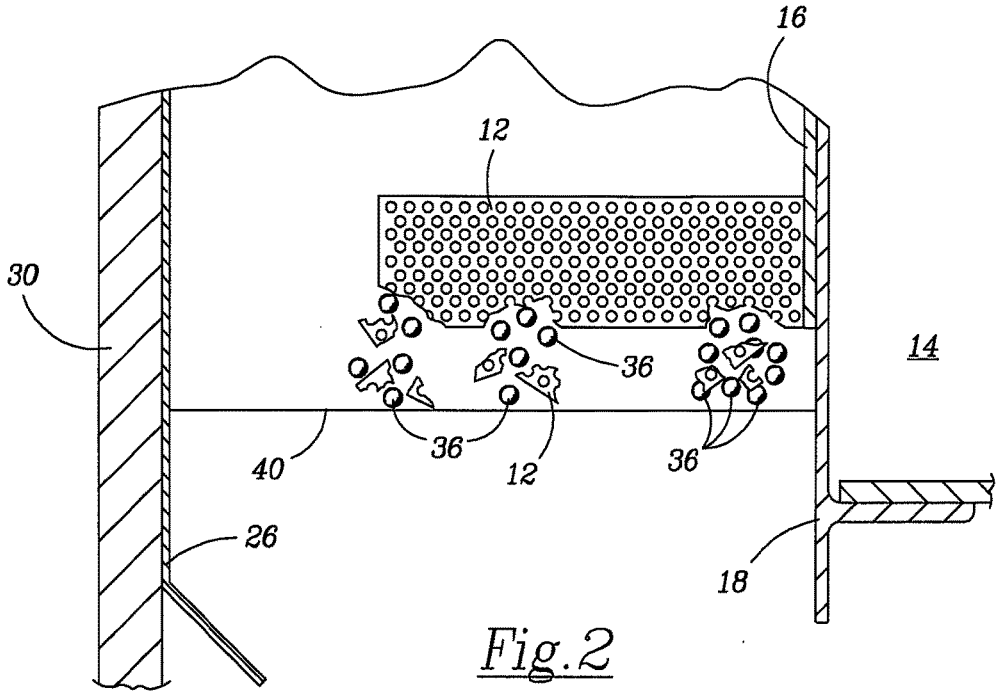
FIG. 2 is a side elevational view of the box-like container of the present invention showing several points of disintegration of the container allowing the fire suppressant material to be discharged downward onto the surface of the stored fluid.

The box-like container 12 containing the fire suppressant material is positioned just above the level 40 of the stored liquid in the example shown in FIG. 1 in order to not be affected by any potential corrosion from the liquid over time. The container 12 is configured to maintain a sufficient rigidity even though multiple rows of perforations are placed along all sides and both faces of the container. The container 12 is manufactured of a rupturable or meltable plastic material that will break apart or melt at a given temperature, i.e., the temperature of a fire fueled by the stored liquid. As shown in FIG. 2, the container 12, in reaction to the heat generated by a fire of the stored liquid at or near its location along the rim 18 of the floating roof 14, begins to disintegrate or melt allowing the fire suppressant materials stored within to drop, along with pieces of the container 12, to the surface of the stored liquid 40.

Housed within the container 12 are a multiplicity of spheres 36 that comprise the fire suppressant material. The spheres 36, also made of plastic, drop onto the surface of the liquid 40 along with segments of the container 12 creating an oxygen barrier before they melt due to the heat of the fire. See, FIG. 3. The fire suppressant system 10 responds immediately to the increased temperature with the container 12 rupturing or disintegrating and dropping the spheres 36 onto the surface 40 of the stored liquid creating an oxygen barrier and suppressing any fire. The material of the spheres 36 will need to be of a higher melt temperature so that they can be effect in creating the oxygen barrier at the surface of the flammable material.

Figure 5:
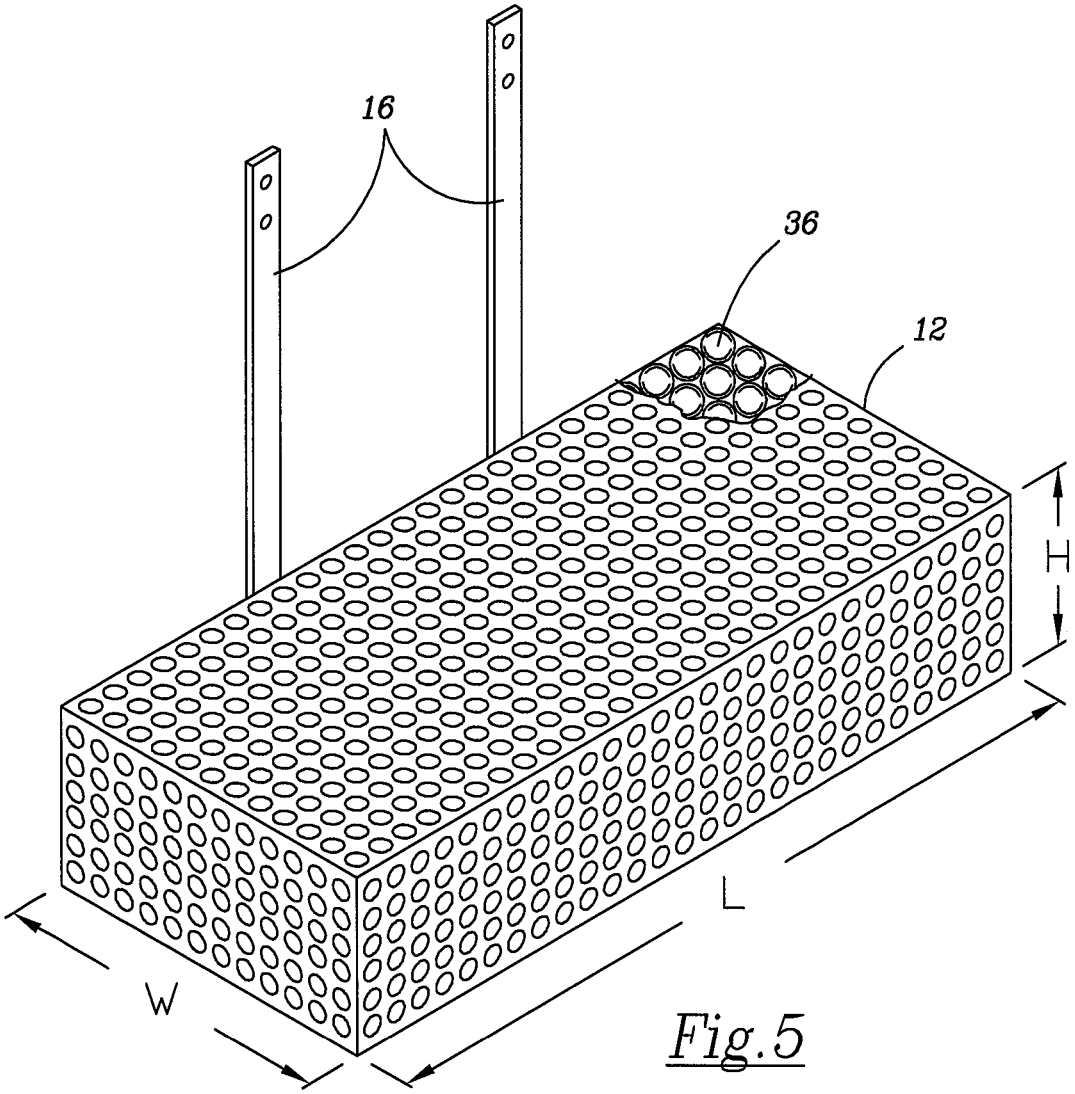
FIG. 5 is a perspective view of the box-like container and fire suppressant materials of the present invention showing the plurality of container perforations, the mounting straps for mounting the container to the floating roof, and in the partial cutaway a system for stacking the fire suppressant materials to achieve maximum storage within the container.

Referring now to FIG. 5, the container 12 is dimensioned to fit within the rim space between the floating roof 14 and the tank wall 30. This rim space is approximately 8 inches with the adjustment of the floating roof 14 therein the working dimension for the container 12 will be reduced to a maximum width W of 4 inches. The length dimension L of the container 12 along the periphery of the rim 18 will be dependent upon the curvature of the surface of the rim 18 and whether the container 12 is similarly curved along one side, the side adjacent the rim 18, or the container retains a rectilinear shape. The preferred length of the container 12 is in the range of 12-18 inches as this length will be minimally affected by the curvature of the rim 18. The depth or height H of the container 12 is dependent upon the space available within the rim space above the stored liquid level and any mechanism controlling a seal or the seal itself. In the example of FIG. 1, the container 12 is positioned above the liquid level 40 and below the outwardly extending support arm 24 for the shoe seal 26. The placement of the container 12 proximate to the liquid level 40 required by the positioning of the support arm 24 and shoe seal 26 in this example still allows the fire suppressant materials to be retained within the rim space between the floating roof 14 and the tank wall 30 and below the top of the floating roof to allow for the best opportunity to suppress any limited fire within the rim space. Therefore, the height H of the container 12 will be dependent upon the vertical space available between the stored liquid level and the seal mechanisms. In this example the vertical depth or height H of the container 12 can be in the range of 4-6 inches. With these ranges of dimensions the container 12 can house fire suppressant materials sufficient to suppress a fire within the rim space along the surface area of the stored liquid immediately adjacent the location of the container 12 along the perimeter of the rim 18 of the floating roof 14.

The present invention contemplates a plurality of containers 12 positioned within the rim space and disposed at locations extending around the periphery of the rim 18 of the floating roof 14. The number and exact positioning of the containers 12 will depend upon the dimensions of the tank and the floating roof 14. Additionally, the spacing of the containers 12 along the rim 18 will also depend upon the number of stored fire suppressant spheres 36 that are housed within the containers 12 as there are a minimum number of spheres 36 required to cover the stored liquid surface within a segment of the rim space to blanket that surface area and create an oxygen barrier to suppress the spread of a fire.

Figure 3:
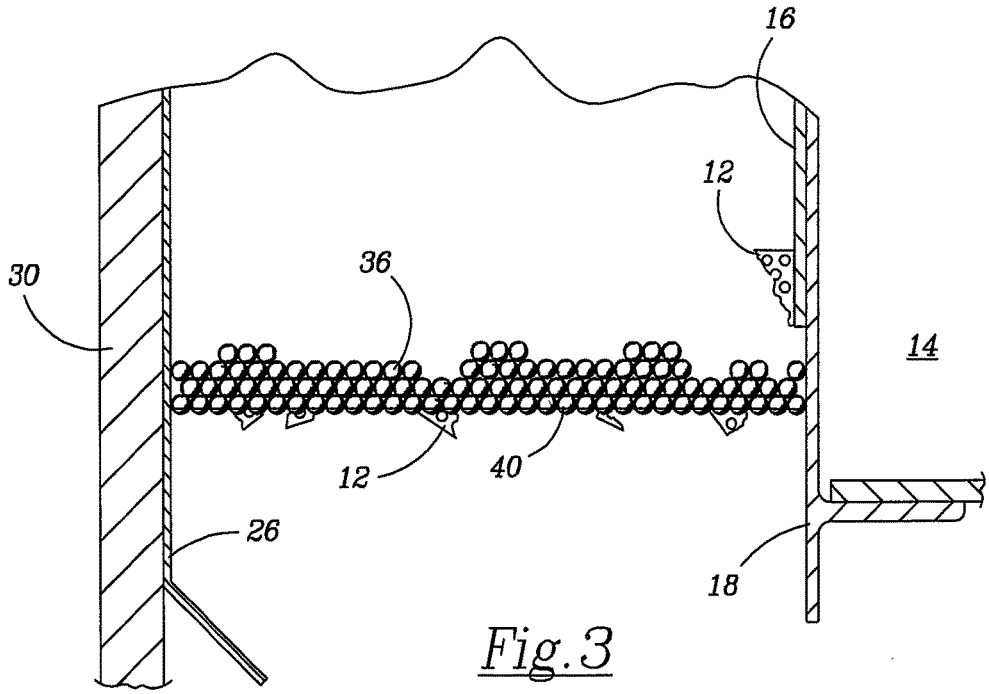
FIG. 3 is a side elevational view of the fire suppressant material arrayed across the surface area of the stored fluid within the rim space between the floating roof and the storage tank wall.

The fire suppressant spheres 36 may be made of a plastic material that will melt at approximately the temperature of the fire when the stored liquid combusts. The spheres 36 may also be made of an intumescent material that will resist combustion and/or melting for a longer period of time. The number of spheres 36 required for blanketing a limited surface area of the stored liquid within the rim space will depend upon the size of the spheres and whether all of the spheres are of the same dimension. It is possible to have differently sized spheres 36 to achieve a more closely packed blanket, or sphere layers as shown in FIG. 3.

The size of the spheres 36 can also depend upon the size of the container 12 as the dimensions of the container may be restricted due to the available space for mounting in the rim space. Thus, if the size of the container 12 is restricted, which will limit the number of spheres 36 contained therein, the number of containers 12 must be increased to cover the entire rim space with a sufficient number of spheres 36 to blanket the surface area of the liquid in the event of a fire in the rim space. Although the fire suppressant materials have been described as spheres, other solid geometric shapes, e.g., pyramidal, solid rectangular, etc., will be just as suitable for the intended purpose of smothering any stored liquid fire at the location of its ignition.

Figure 4:
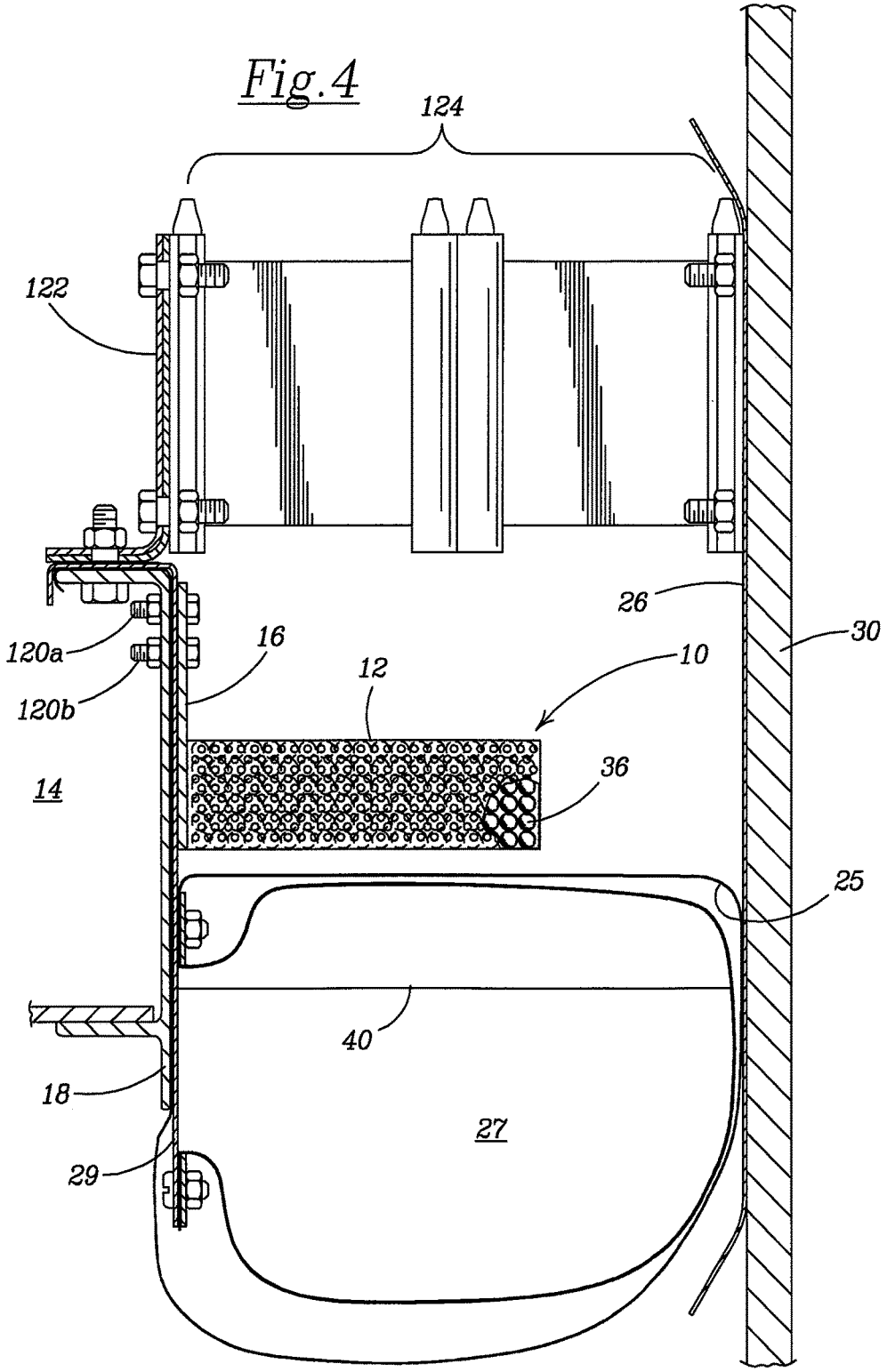
FIG. 4 is a side elevational view of the box-like container of the present invention partially cut away to reveal the fire suppressant materials housed therein disposed within the rim space by mounting to the exterior of the floating roof above the stored liquid surface, below the top of the floating roof, and between the upper and lower seals attached to the floating roof.

An alternative placement of the container 12 may be required for different seal configurations in the rim space area of volatile fluid storage tanks. With reference to FIG. 4, there is shown a different configuration of a seal mechanism between the floating roof 14 and the tank wall 30. As in the first example, as shoe seal 26 is positioned against the tank wall 30 held in position by a spring force mechanism 124 that maintains tension forcing the shoe seal 26 against the tank wall 30. The spring force mechanism is mounted to the floating roof 14 by way of a vertical extension 122 attached to the top of the floating roof 14 to assist in maintaining the central position of the floating roof within the tank. A resilient material filled seal 27 is mounted to an extension arm 29 extending downward from the rim 18 of the floating roof 14 such that the resilient seal 27 is positioned at or just above the liquid level 40. Surrounding the resilient seal 27 is a fabric bag 25 that is positioned around the resilient seal 27 to protect the seal from abrasion or rupture. The fabric bag 25 is connected to the downward extension 29 and encompassing the seal 27 is attached at its other end to the rim 18 of the floating roof 14. The fire suppressant container 12 is mounted to the rim 18 of the floating roof 14 by hangers 16 above the fabric protection bag 25 and below the top of the floating roof 14. In the event of a failure of the resilient seal 27 and the collapse of the fabric bag 25, or the rupture of the resilient seal 27 due to a spontaneous combustion, the container 12 will be exposed to the stored liquid and will rupture or disintegrate in the same manner as described above depositing the fire suppressant spheres 36 across the exposed surface area of the liquid surface creating an oxygen barrier. The fire suppressant system 10 will significantly reduce any catastrophic temperature increase and possibility of explosion by creating the oxygen barrier and allowing the foam fire extinguishing material to reach the affected area without major damage to the structures.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A fire suppressant system for retarding the spread of a fire of a stored flammable liquid in an annular space between a floating roof and a wall of a storage tank surrounding the floating roof comprising:

the floating roof set off from the wall of the storage tank by a self-centering seal extending over the surface of the stored flammable liquid in the annular space between the floating roof and said wall of the storage tank, said floating roof having a rim circumscribing the floating roof and a top surface;

a plurality of containers mounted within the annular space at predetermined locations along the rim of the floating roof above the flammable liquid for holding a plurality of fire suppressant bodies, each of said plurality of containers responsive to an increase in temperature caused by combustion of the flammable liquid by rupturing or disintegrating and releasing the plurality of fire suppressant bodies to the liquid surface below;

said fire suppressant bodies dropping to the flammable liquid surface create an oxygen barrier over the flammable liquid along said liquid surface for suppressing any fire within the annular space.

2. The fire suppressant system of claim 1 wherein said plurality of containers are mounted along the rim of the floating roof between the surface of the flammable liquid and a point below the top surface of the floating roof.

3. The fire suppressant system of claim 1 wherein the shape of said fire suppressant bodies is selected from the group consisting of spherical, pyramidal and rectangular solid geometric shapes, a number of each selected solid shape capable of being retained within each of said plurality of containers.

4. The fire suppressant system of claim 1 wherein a material of said fire suppressant bodies is selected from the group consisting of high melt temperature plastics wherein melting occurs at the temperature of combustion of the stored flammable liquid, intumescent materials, or combinations thereof.

5. The fire suppressant system of claim 1 wherein said plurality of containers are dimensioned to fit within the annular space along the rim of the floating roof so as not to be crushed and ruptured as the floating roof continues to self-center itself on the surface of the flammable liquid.

6. The fire suppressant system of claim 1 wherein said predetermined locations for the mounting of the plurality of containers along the rim of the floating roof are determined based upon the number of fire suppressant bodies that can be housed within the said containers and the surface area of the flammable liquid that these fire suppressant bodies must cover to create the oxygen barrier for fire suppression.

7. A fire suppression apparatus for retarding the spread of a fire of a stored flammable liquid in an annular space between a floating roof and a wall of a storage tank surrounding the floating roof comprising:

a series of containers for holding a plurality of fire suppressant bodies mounted at predetermined locations along a rim circumscribing the floating roof above the flammable liquid within the annular space created between the floating roof and the wall of the storage tank by a self-centering seal extending over the surface of the flammable liquid;

each of said series of containers being responsive to an increase in temperature caused by combustion of the flammable liquid by rupturing or disintegrating and releasing the plurality of fire suppressant bodies to the liquid surface below;

said fire suppressant bodies dropping from each disintegrating or rupturing container of said series of containers to the flammable liquid surface creating an oxygen barrier over the flammable liquid along said liquid surface for suppressing any fire within the annular space.

8. The fire suppressant apparatus of claim 7 wherein each of said series of containers is mounted along the rim of the floating roof between the surface of the flammable liquid and a point below a top surface of the floating roof.

9. The fire suppressant apparatus of claim 7 wherein each of said series of containers is dimensioned to fit within the annular space along the rim of the floating roof so as not to be crushed and ruptured as the floating roof continues to self-center itself on the surface of the flammable liquid.

10. The fire suppressant apparatus of claim 7 wherein said predetermined locations for the mounting of the series of containers along the rim of the floating roof are determined based upon the number of fire suppressant bodies that can be housed within the said containers and the surface area of the flammable liquid that these fire suppressant bodies must cover to create the oxygen barrier for fire suppression.

11. The fire suppressant apparatus of claim 7 wherein said fire suppressant bodies are selected from the group consisting of spherical, pyramidal and rectangular solid geometric shape, a number of each selected solid shape capable of being retained within each of said plurality of containers.

12. The fire suppressant apparatus of claim 7 wherein a material of said fire suppressant bodies is selected from the group consisting of high melt temperature plastics wherein melting occurs at the temperature of combustion of the stored flammable liquid, intumescent materials, or combinations thereof.

13. A method for the retarding the spread of a fire within an annular space formed between a floating roof and a wall of a flammable liquid storage tank surrounding the floating roof comprising the steps of:

providing a series of containers for holding a plurality of fire suppressant bodies mounted at predetermined locations along a rim circumscribing the floating roof above a flammable liquid within the annular space created between the floating roof and the wall of the storage tank by a self-centering seal extending over the surface of the flammable liquid;

said series of containers being responsive to an increase in temperature caused by combustion of the flammable liquid by rupturing or disintegrating and releasing the plurality of fire suppressant bodies to the liquid surface below;

dropping said fire suppressant bodies from each disintegrating or rupturing container of said series of containers to the flammable liquid surface creating an oxygen barrier over the flammable liquid along said liquid surface for suppressing any fire within the annular space.

14. The method for the retarding the spread of a fire of claim 13 further comprising the step of mounting each of said series of containers along the rim of the floating roof between the surface of the flammable liquid and a point below a top surface of the floating roof.

15. The method for the retarding the spread of a fire of claim 13 further comprising the step of dimensioning each of said series of containers to fit within the annular space along the rim of the floating roof so as not to be crushed and ruptured as the floating roof continues to self-center itself on the surface of the flammable liquid.

16. The method for the retarding the spread of a fire of claim 13 further comprising the step of mounting the of the series of containers along the rim of the floating roof based upon the number of fire suppressant bodies that can be housed within the said containers and the surface area of the flammable liquid that these fire suppressant bodies must cover to create the oxygen barrier for fire suppression.

17. The method for the retarding the spread of a fire of claim 13 further comprising the step of selecting said fire suppressant bodies from the group consisting of spherical, pyramidal and rectangular solid geometric shapes, a number of each selected solid shape capable of being retained within each of said plurality of containers.

18. The method for the retarding the spread of a fire of claim 13 further comprising the step of selecting a material of said fire suppressant bodies from the group consisting of high melt temperature plastics wherein melting occurs at the temperature of combustion of the stored flammable liquid, intumescent materials, or combinations thereof.

* * * * *